US005791945A

United States Patent [19]

Myer et al.

[11] Patent Number: 5,791,945

[45] Date of Patent: Aug. 11, 1998

[54] HIGH FORCE CONTACT

[75] Inventors: John M. Myer, Millersville, Pa.; Hoy S. Beck, Jr., Lexington, N.C.

[73] Assignee: The Whitaker Corporation, Wilmington, Del.

[21] Appl. No.: 421,634

[22] Filed: Apr. 13, 1995

[51] Int. Cl.[6] ..... H01R 11/22

[52] U.S. Cl. ..... 439/852

[58] Field of Search ..... 439/852, 851, 439/839

[56] References Cited

U.S. PATENT DOCUMENTS

| | | | |
|---|---|---|---|
| 3,713,080 | 1/1973 | Kennedy | 439/852 |
| 3,836,947 | 9/1974 | Yeager | 339/259 R |
| 3,977,757 | 8/1976 | Yurtin | 339/217 S |
| 4,699,444 | 10/1987 | Isohata | 439/839 |
| 4,772,225 | 9/1988 | Ulery | 439/620 |
| 4,789,847 | 12/1988 | Sakamoto et al. | 333/185 |
| 4,834,681 | 5/1989 | Chaillot | 439/856 |
| 4,838,816 | 6/1989 | Matsusaka et al. | 439/861 |
| 4,862,311 | 8/1989 | Rust et al. | 361/91 |
| 4,894,630 | 1/1990 | Ueta et al. | 333/185 |
| 4,919,628 | 4/1990 | Mobley et al. | 439/858 |
| 4,950,169 | 8/1990 | Martin et al. | 439/44 |
| 5,112,254 | 5/1992 | Endo | 439/852 |
| 5,181,864 | 1/1993 | Wakino et al. | 439/620 |
| 5,281,175 | 1/1994 | Chupak et al. | 439/839 |
| 5,443,592 | 8/1995 | Ittah et al. | 439/851 |

FOREIGN PATENT DOCUMENTS

| | | | |
|---|---|---|---|
| 0025366 | 3/1981 | European Pat. Off. | 439/852 |
| 2 627 020 | 11/1989 | European Pat. Off. | H01R 11/22 |
| 633 592 | 1/1995 | European Pat. Off. | H01H 85/045 |

*Primary Examiner*—Khiem Nguyen
*Assistant Examiner*—Eugene G. Byrd

[57] ABSTRACT

An electrical receptacle contact (10) having a contact termination section (20), a wire termination section (40), and an insulation gripping section (50). The contact termination section (20) includes a primary cantilever beam (26), a secondary cantilever beam (27), and an overstress stop (28) with a gap arranged therebetween for the purpose of assuring that the beams (26,27) are not preloaded. The alignment of the primary and secondary cantilever beams (26,27) with the overstress stop (28) advantageously protects the beams (26,27) from overstress.

19 Claims, 4 Drawing Sheets

HIGH FORCE CONTACT

The present invention relates to an electrical receptacle contact for receiving a pin or blade contact therein. More particularly, the present invention relates to an electrical receptacle contact having a pair of balanced cantilever beams therein for forcefully biasing against a blade or pin contact, and the receptacle contact includes an overstress member for preventing the overstress of the cantilever beams.

BACKGROUND OF THE INVENTION

An electrical receptacle contact is disclosed in U.S. Pat. No. 5,112,254. This known electrical receptacle contact includes a pair of cantilever beams for engaging a complementary pin contact for electrical connection therewith. This known connector includes a front cover portion for preventing the pin from being inserted behind one of the cantilever beams, and the cantilever beams are connected to each other with the lower of the two cantilever beams engaging a bottom of the receptacle contact. This known electrical connector advantageously provides a means for interconnection between a receptacle contact and a blade or pin contact; however, this known invention is likely to have high insertion forces because the cantilever beams are preloaded, i.e. they are in frictional engagement with each other prior to insertion of a beam or pin. Moreover, the lower cantilever beam is preloaded against a bottom surface of the receptacle thereby requiring additional force to deflect it during insertion of the pin, and the contact cover is an additional member which adds expense to the manufacture of the electrical contact.

Another electrical receptacle contact is disclosed in U.S. Pat. No. 3,836,947. This second known device provides a pair of deflectable cantilever beam arms in engagement with each other when a pin contact is inserted into the receptacle contact. Both cantilever beams are inclined at generally the same angle and in the same direction toward the pin to be inserted. The second cantilever beam member at the top is a stop means against which the other cantilever beam will engage in order to limit the deflection of the first, lower cantilever beam. The top cantilever beam acts as the functional equivalent of a spring assist relative to the lower cantilever beam. When a pin contact is inserted into the receptacle, both the lower cantilever beam and the top cantilever beam deflect, thereby increasing the gripping force of the lower cantilever beam on the pin. This known invention advantageously provides a means to interconnect receptacle and pin contacts; however, the fact that the top "assist" cantilever beam also acts as a stop member is likely to undesirably increase the variable rate of contact insertion force. Moreover, the top cantilever beam can cause the resistance to contact insertion to sharply increase at the moment that the top cantilever beam becomes fully operative against the lower cantilever beam. Additionally, when the pin has been fully inserted into the receptacle, the lower cantilever beam engages the assist cantilever beam and a portion of the receptacle contact wall that the assist cantilever beam extends from will undergo an "unfolding" force.

A further known receptacle contact is disclosed in U.S. Pat. No. 5,281,175. This known receptacle contact provides two cantilever beams one of which primarily engages a pin contact when it is inserted into the receptacle, and the other cantilever beam is an assist cantilever beam relative to the primary beam. The assist cantilever beam is always in engagement with the primary cantilever beam. Neither of the cantilever beams comprise radius curves but, rather, include relatively small, acute angle bends. This known connector advantageously provides a means to electrically interconnect a pin contact with a receptacle contact; however, this arrangement is likely to require high insertion forces because of the additive effect of the flexure inertia associated with simultaneously deflecting the acute angle bends of both the assist and primary cantilever beams.

SUMMARY OF THE INVENTION

The present invention provides an electrical receptacle contact comprising a contact termination section for electrically receiving a further electrical contact having an insertion direction for inserting the further electrical contact into the receptacle contact, and the receptacle contact includes another section for connection to an electrical conductor. The contact termination section comprises resiliently deflectable primary and secondary cantilever beams, the primary beam is adapted to engage the further electrical contact, and the beams are in an unstressed state prior to insertion of the further contact.

The present invention seeks to overcome the disadvantages of the prior contacts by providing a contact assembly which: has an overstress member for providing overstress protection to at least one of the beams independently of the at least one beam because the overstress member does not deflect therewith; advantageously includes preselected radii and flexure inertii (by preselecting cross sectional areas) for the respective cantilever beams for imparting a balanced degree of compliancy to the beams and thereby controlling the contact forces generated by insertion of the pin or blade; has a locking tab and tab aperture for preventing unfolding forces acting on the contact form; advantageously provides low initial contact insertion forces by virtue of the fact that the beams are not preloaded, but which forces increase at a desirably gradual rate without a sharp increase; and is easy to make and use, and is of a low manufacturing cost.

DETAILED DESCRIPTION OF THE INVENTION

Figure 1:
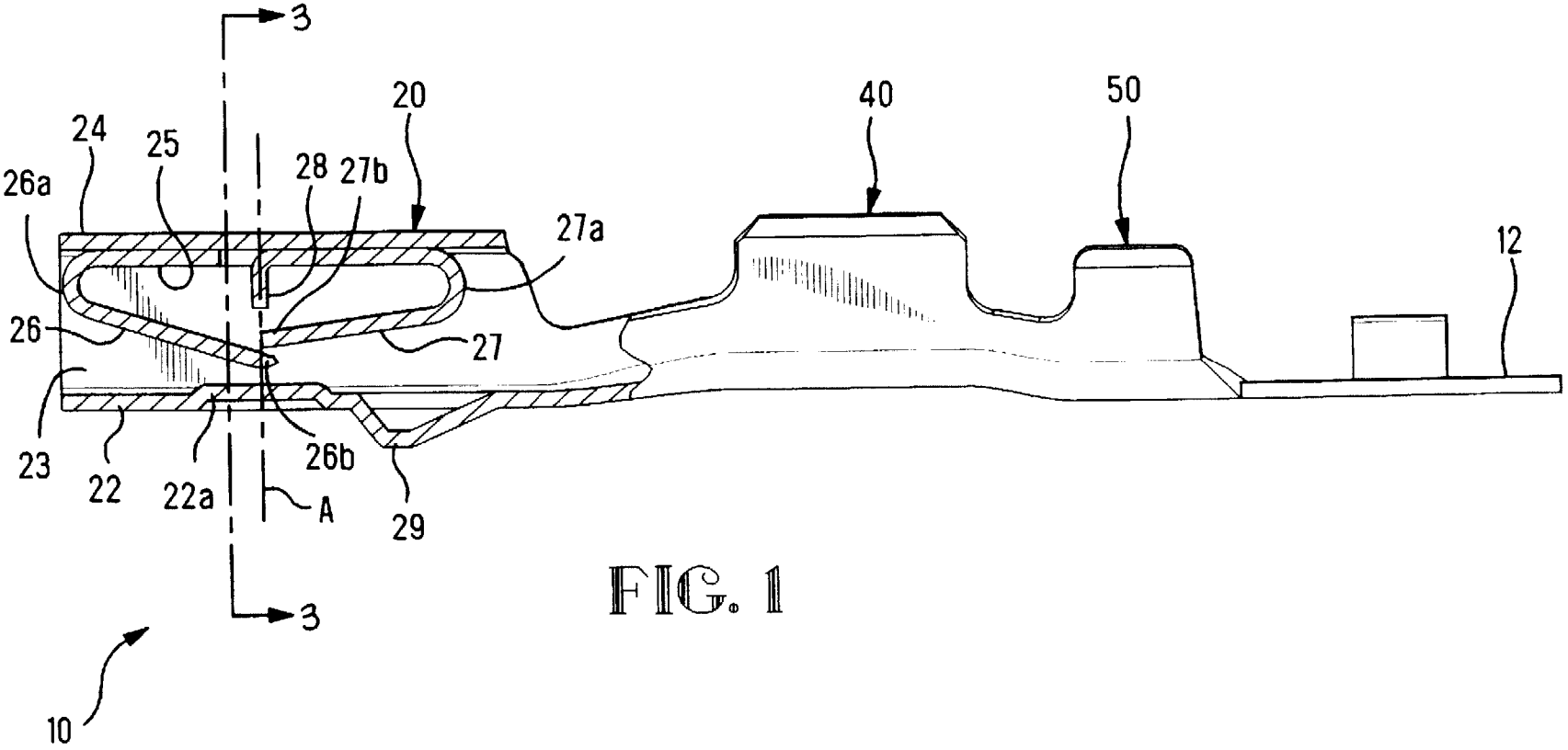
FIG. 1 shows a partial cross section of a side view of an electrical receptacle contact according to the present invention.

FIG. 1 shows an electrical receptacle contact 10 having a contact termination section 20, a wire termination section 40, and an insulation gripping section 50. Contact 10 is shown connected to a carrier strip 12 as will be the case after the contact has been stamped and formed but prior to severance of contact 10 from the carrier strip 12. Contact termination section 20 includes a base portion 22 with a platform 22*a*, sidewalls 23, an outer top wall 24, an inner top wall 25, a primary cantilever beam 26 with a bend 26*a*and a tip 26*b*, a secondary cantilever beam 27 with a bend 27*a* and a tip 27*b*, an overstress stop 28, and an offset portion 29. Wire termination section 40 is a crimpable section for crimping to the conductive core of a wire not shown in the drawing. In like manner, insulation gripping section 50 is a crimpable section for crimping to the insulation surrounding the core of a wire not shown in the drawing. Plane "A" depicts a plane which intersects a portion of beams 26 and 27, and overstress 28.

Figure 2:
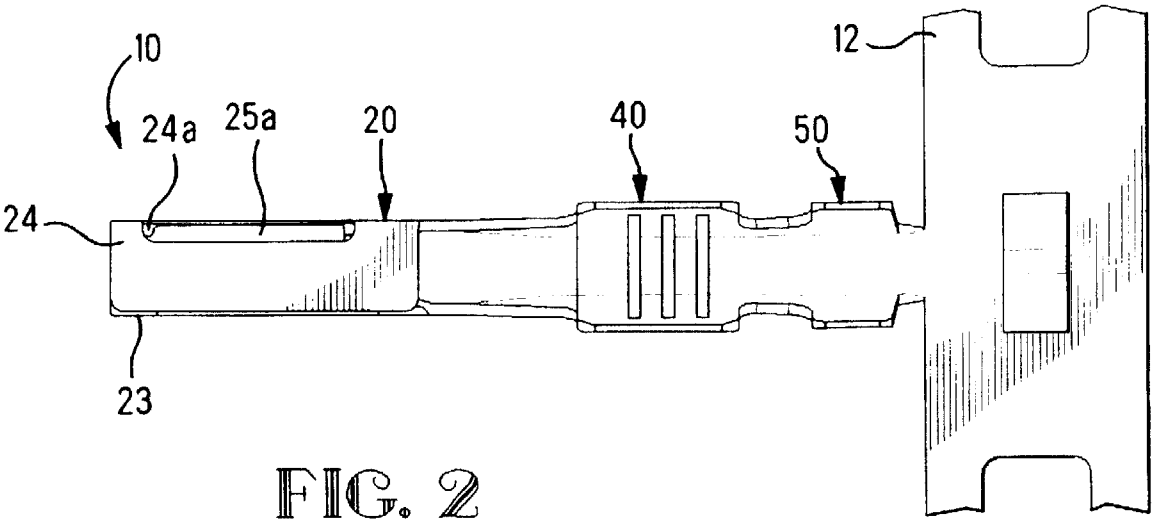
FIG. 2 shows a top view of the receptacle contact according to the present invention.

Referring to FIG. 2, outer top wall 24 includes a tab aperture 24*a* which receives a locking tab 25*a* of inner top wall 25 for preventing unfolding forces acting on the contact form.

Figure 3:
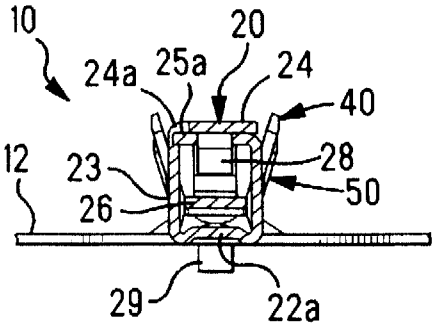
FIG. 3 shows a front cross sectional view of the electrical receptacle contact of FIG. 1 taken along line 3—3.

Referring now to FIG. 3, a front, cross sectional view of the receptacle contact of FIG. 1 taken along line 3—3 is shown. FIG. 3 also shows how locking tab 25*a* fits into tab aperture 24*a* of top wall 24.

Figure 4:
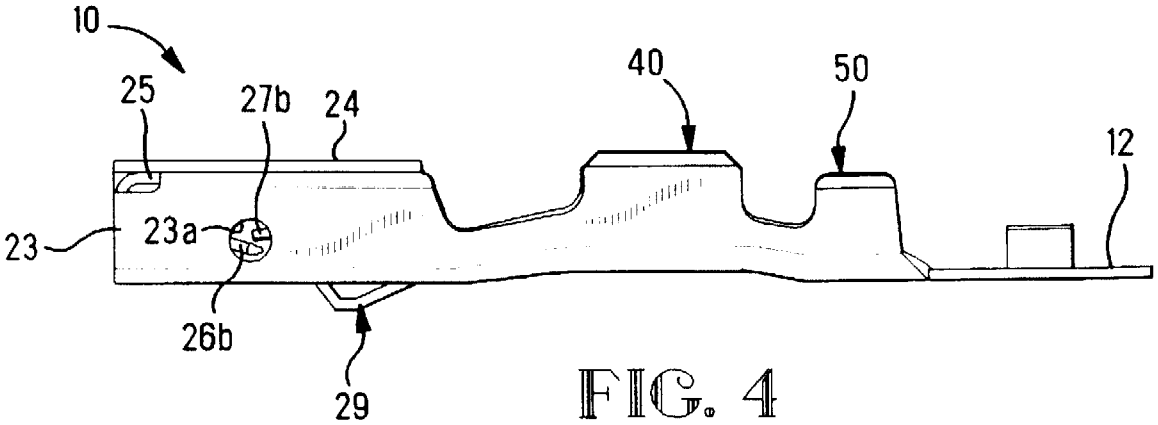
FIG. 4 shows a side elevational view of the electrical connection of FIG. 2.

Referring to FIG. 4, a side view of the receptacle contact 10 is shown with hole 23*a* of wall 23 exposing the end portions of primary cantilever beam 26 and secondary cantilever beam 27.

Figure 5:
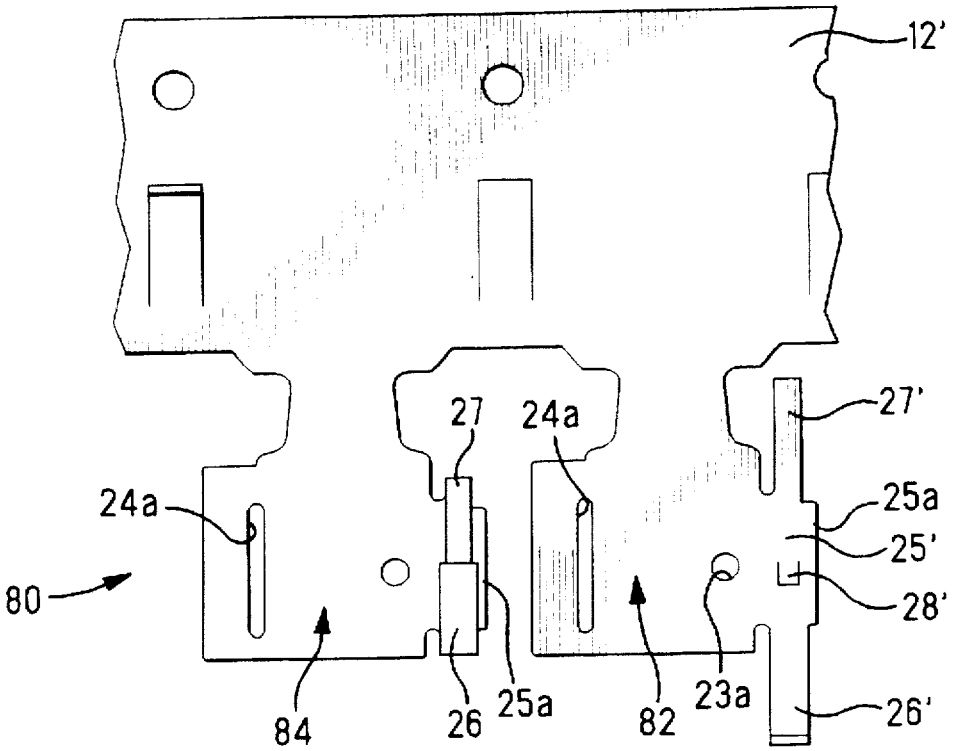
FIG. 5 shows a pair of receptacle contacts of the present invention when connected to a carrier strip in a blank form, with the cantilever beam members of the left hand side contact having been formed.

FIG. 5 shows the electrical contact according to the present invention while in the form of a blank of generally constant thickness. Blank 80 shows two blank sections 82 and 84. Section 82 shows tab 25*a*, primary and secondary cantilever beams 26 and 27 in their preformed state as 26' and 27', and shows inner top wall 25' with overstress stop 28'. Note the width of preformed primary beam 26' is relatively larger than the width of preformed secondary beam 27', thereby resulting in a differential as between the respective cross sectional areas of the beams for purposes of flexure, as further described below. Hole 23*a* is shown adjacent to tab aperture 24*a*. Blank section 84 shows primary cantilever beam 26 and secondary cantilever beam 27 after having been folded towards each other during a forming process.

Figure 6:
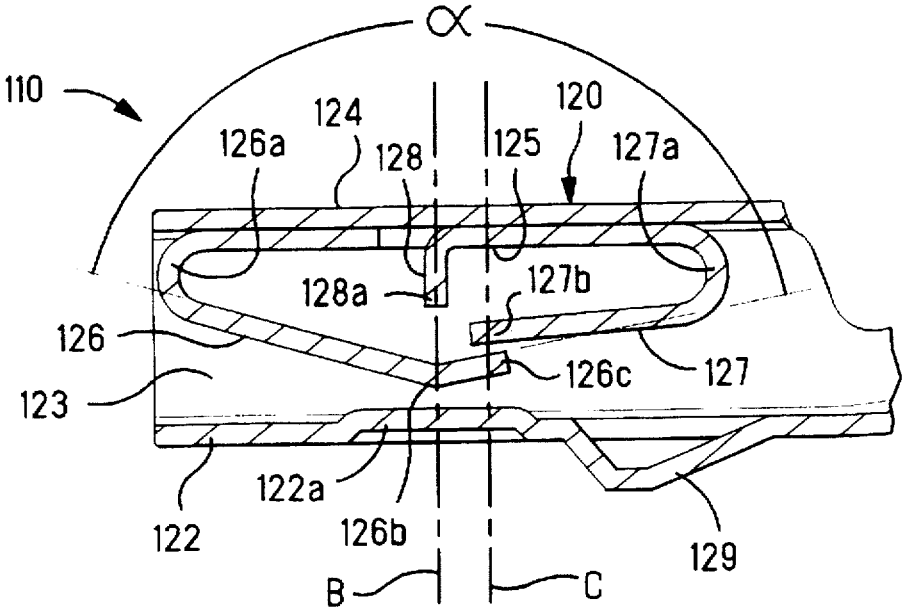
FIG. 6 shows a second embodiment of the receptacle contact according to the present invention.

FIG. 6 shows a further embodiment of the present invention with substantially all of the features thereof the same as in FIG. 1. Contact receptacle 100 includes a contact termination section 120, a base portion 122 with a platform 122*a*, side walls 123, outer top wall 124, an inner top wall 125, a primary cantilever beam 126, a bend 126*a*, a secondary cantilever beam 127 with a bend 127*a*, an overstress stop 128, an offset portion 129, and a wire termination section and insulation gripping section (not shown in the drawing). Additionally, a bend 126*b* has been added to the primary cantilever beam 126 with an angle $\alpha$ as shown. Moreover, a plane shown as "B" and a plane defined at "C" show that the overlapping feature as shown in plane "A" of FIG. 1 has been changed. Here, plane C shows an overlap between the cantilever beams 126 and 127, but which overlap does not align with plane B of the stop member 128 (as was the case in FIG. 1).

Figure 7:
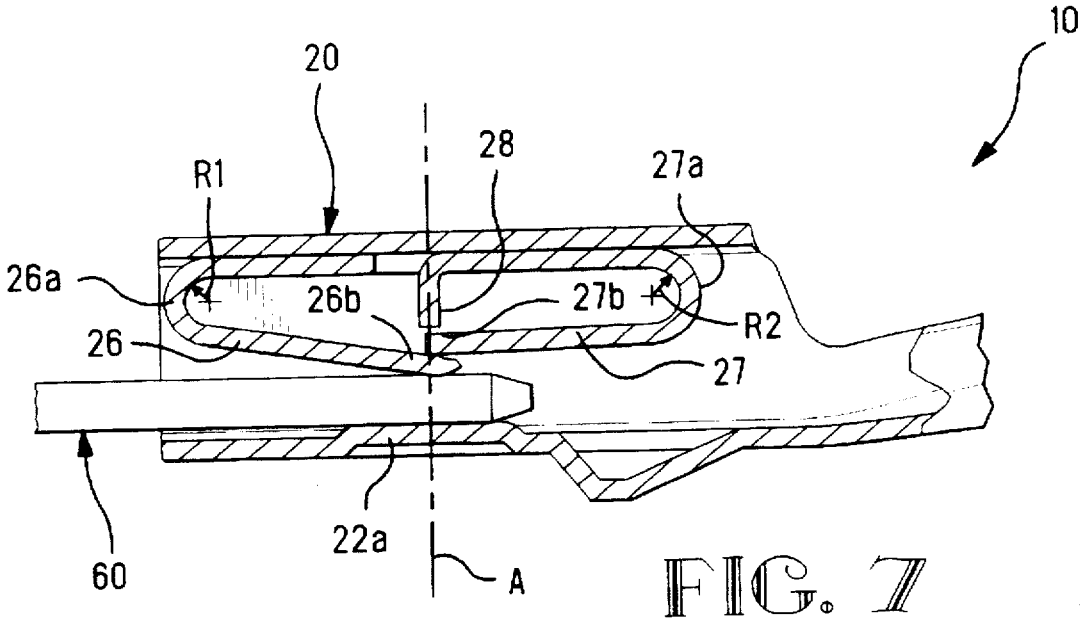
FIG. 7 shows a cross sectional view of a portion of the contact of FIG. 1 with a pin contact inserted therein.
Figure 8:
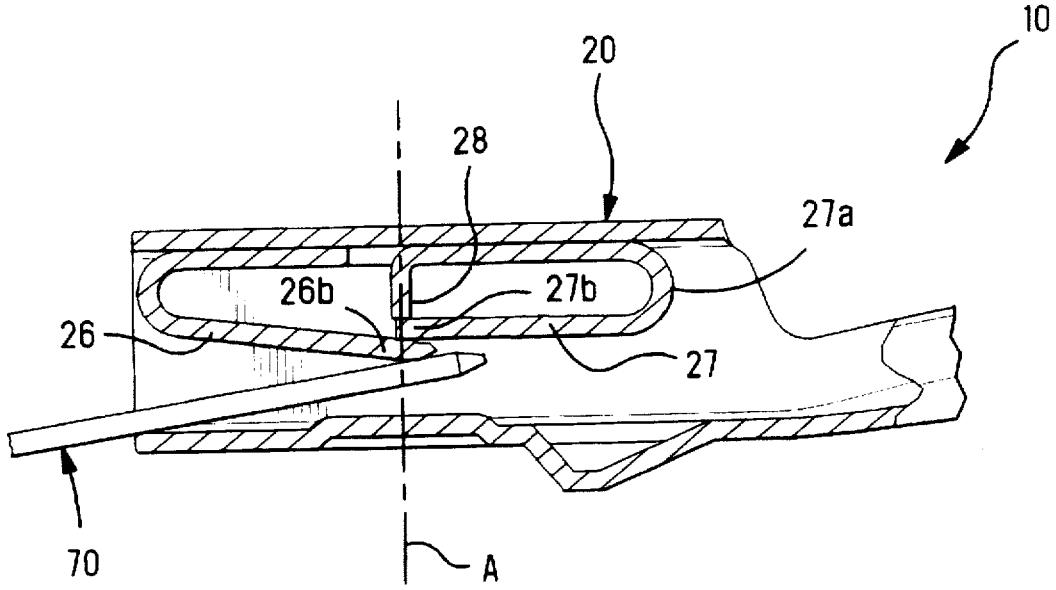
FIG. 8 shows a cross sectional view of a portion of the contact of FIG. 1 with a test probe inserted therein.

Referring now to FIGS. 7–8, operation of the contact 10 as an example of the invention will now be described with the understanding that the principles described below will be, in large part, equally applicable to contact 110. FIG. 7 shows a pin contact 60 inserted into contact 10 with the pin contact 60 engaging a radiused curve formed on tip 26*b* of primary cantilever beam 26 for sliding engagement with the primary cantilever beam. The radiused curve reduces the coefficient of sliding friction between tip 26*b* and pin contact 60. Prior to insertion of pin contact 60, however, the primary cantilever beam 26 and secondary cantilever beam 27 comprise a gap between their respective tip ends 26*b* and 27*b*, therefore, the beams are not preloaded. This is an advantage over preloaded beams in that the lack of preload advantageously provides low initial contact insertion forces.

Moreover, as the contact being inserted progresses and the beams 26 and 27 come into contact with each other, the insertion force will increase gradually. As noted in FIG. 7, bend 26 has a complementary radius R1, and bend 27 has a complementary radius R2. In a preferred embodiment, R2 is greater than R1, and the cross sectional areas of the beams 26 and 27 in the area of the respective radii are such that the flexure inertia of beam 27 is less than beam 26. During deflection of the primary and secondary cantilever beams 26 and 27, therefore, cantilever beam 27 will be relatively more compliant, i.e. will have a higher degree of flexibility or deflection because of its larger radius R2 and lower flexure inertia. Therefore, the flexibility of the beams, as the term is used here, is a force per unit deflection rather than a mere geometric measurement of deflection. Thus the beams 26 and 27 advantageously include a pair of respective preselected radius bends and flexure inertia for imparting a balanced degree of compliancy to the beams and thereby confining the contact forces generated by insertion of the pin or blade to a gradual increase.

In view of the foregoing, prior to insertion of pin contact 60, there is a gap between tip 26*b* and 27*b*. However, it is preferred that there will be a gap between the tip of 27*b* of beam 27 and overstress 28. As shown in FIG. 7, pin contact 60 when in the fully 20 inserted position, is biased against platform 29*a* by the additive biasing effects of the cantilever beam 26 and 27. The platform 29*a* defines the points of contact between the pin 60 and contact 10, and prevents stubbing.

Now referring to FIG. 8, a use of the contact 10 with a test probe 70 is described. As shown in the drawing figure, test probe 70 is inserted at an angle which tends to deflect both beams 26 and 27 into engagement with each other, and beam 27 is deflected into engagement with overstress member 28. Plane A is shown in alignment with beams 26,27 and overstress 28, which alignment is advantageous because both beams 26 and 27 have the benefit of the overstress member 28 in preventing the overstress thereof. This also helps to minimize deleterious tolerance factors. In a preferred embodiment, both cantilever beams 26 and 27 have the approximately same length, the beams will touch each other at the general vicinity of the centerline of overstress 28, and, as noted above, are arranged in an unloaded state before insertion of a pin contact 60 or test probe 70. However, when the pin contact 60 or probe 70 has been properly inserted, both beams 26 and 27 are always in engagement.

It should be noted, however, that when a pin contact 60 or test probe 70 is inserted into contact 110 of FIG. 6 above, there will likewise be a gap between tip 126*c* and 127*b* of beams 126 and 127 prior to insertion of the pin contact. However, as the pin contact is inserted into contact 110, tip 126*c* will slidingly engage the lower surface of cantilever beam 127, and bend 126*b* will slidingly engage the pin contact as the same is inserted. But only beam 126 will have the benefit of the overstress feature 128 when a test probe is, for example, inserted into contact 110 at an angle as shown in FIG. 8.

It is preferred that contacts 10 and 110 are stamped and formed contacts made of a high strength, high conductivity, and low cost metal, for example: copper, brass, bronze, beryllium copper, copper alloys, steel, nickel, aluminum, or zinc. To assure both electrical and mechanical integrity of the contacts, the final manufacturing process preferably includes the application of a corrosive resistant finish known to those of ordinary skill as a coating or plating. Preferably, the plating material would comprise tin, tin low lead, tin lead, nickel, gold, silver, copper, zinc and/or palladium. The platings are preferably applied to the contacts by a process known to those of skill in the plating art as electrodeposition.

Thus, while preferred embodiments of the invention have been disclosed, it is to be understood that the invention is not to be strictly limited to such embodiments but may be otherwise variously embodied and practiced within the scope of the appended claims.

Accordingly, What is claimed is:

1. An electrical receptacle contact, comprising:

a termination section for receiving a second electrical contact in an insertion direction, the termination section having primary and secondary cantilever beams, the primary cantilever beam being adapted to engage the second contact, the termination section having an overstress member to prevent overstress in the primary and the secondary beam, the secondary beam being disposed between the primary beam and the overstress member, one of the outer walls having a locking tab, another of the outer walls having a locking aperture, the locking tab being received within the locking aperture to secure the outer walls together.

2. The receptacle contact of claim 1, wherein at least one of the beams has a generally longitudinal direction which extends from a base of the at least on beam towards a free end of the at least one beam, and the longitudinal direction is generally opposite to the insertion direction of the further electrical contact.

3. The receptacle contact of claim 1, wherein the overstress member comprises a longitudinal axis thereof which is generally transverse to the contact insertion direction.

4. The receptacle contact of claim 1, wherein the overstress member comprises a tab which is stiff relative to the resiliently deflectable cantilever beams.

5. The receptacle contact of claim 1, wherein each of the beams comprises a free end, and a gap exists between said free ends prior to insertion of the second electrical contact.

6. The receptacle contact of claim 5, wherein the contact termination section includes an overstress member, and a gap exists between the overstress member and at least one of free ends of the beams after insertion of the second electrical contact.

7. The receptacle contact of claim 1, wherein upon flexure of the primary beam, the primary beam engages the overstress member thereby preventing overstress in the primary beam.

8. The receptacle contact of claim 1, wherein the outer walls form generally a box shaped structure.

9. An electrical receptacle contact, comprising:

a termination section for receiving a second electrical contact in an insertion direction, the termination section having outer walls and having primary and secondary cantilever beams, an overstress member extending from the outer walls, during flexure of the cantilever beams, the primary cantilever beam engages the secondary cantilever beam and the secondary cantilever beam engages the overstress member to prevent overstress in both the primary and the secondary cantilever beams.

10. The receptacle contact of claim 9, wherein one of the outer walls has a locking tab and another one of the outer walls has a locking aperture, the locking tab being received within the locking aperture to secure the walls together.

11. The receptacle contact of claim 9, wherein at least one of the beams has a generally longitudinal direction which extends from a base of the at least on beam towards a free end of the at least one beam, and the longitudinal direction is generally opposite to the insertion direction of the further electrical contact.

12. The receptacle contact of claim 9, wherein the overstress member comprises a longitudinal axis thereof which is generally transverse to the contact insertion direction.

13. The receptacle contact of claim 9, wherein the overstress member comprises a tab which is stiff relative to the resiliently deflectable cantilever beams, the overstress member extending from one of the outer walls.

14. The receptacle contact of claim 9, wherein the outer walls form generally a box shaped structure.

15. An electrical receptacle contact, comprising:

(a) a termination section for receiving a second electrical contact in an insertion direction, said termination section comprises first and second wall sections;

(b) said first wall section comprises first and second cantilever beams extending therefrom, an interlocking section for interlocking with an interlocking portion of said second wall, and an overstress member for preventing overstress of said cantilever beams;

(c) said second wall section comprises an interlocking portion which receives said interlocking section of said first wall section therein thereby locking said wall section together;

(d) during flexure of the cantilever beams, the primary cantilever beam engages the secondary cantilever beam and the secondary cantilever beam engages the overstress member to prevent overstress in both the primary and the secondary cantilever beams;

(e) said interlocking section and said interlocking portion are operative to prevent separation of said first and second wall sections upon application of said pressure to said overstress member.

16. An electrical receptacle contact, comprising:

(a) a receptacle section for receiving a further electrical contact, said receptacle section comprises a wall section;

(b) said wall section comprises first and second overlapping layers of conductive material, said overlapping layers thereby define a double thickness wall section;

(c) said first layer of material comprises a primary and a secondary cantilever beams extending therefrom for deflection upon insertion of said further electrical contact into said receptacle section, an engagement section for preventing separation of said first and second layers, and an overstress member comprising a projection which is engageable with said cantilever beams;

(d) said second layer of material comprises an engagement section which cooperates with said first layer engagement section for preventing separation of said first and second layers;

(e) during flexure of the cantilever beams, one of the cantilever beams engages the other of the cantilever beams and the other of the cantilever beams engages the overstress member to prevent overstress in both the cantilever beams; and (f) said first and second layer engagement sections are operative to prevent separation of said layers upon application of said pressure to said overstress member.

17. An electrical receptacle contact, comprising:

(a) a receptacle section for receiving a further electrical contact, said receptacle section comprises a wall section;

(b) said wall section comprises a layer of conductive material;

(c) said layer of material comprises first and second deflectable beams extending therefrom, said first beam is adapted to engage said further electrical contact upon insertion thereof into said receptacle section, said second beam is arranged to be engaged by said first beam upon insertion of said further electrical contact, and said layer of material further comprises an overstress member comprising a projection;

(d) said second beam is disposed intermediate said first beam and said overstress member for engagement with each; and (e) upon insertion of said further electrical contact into said receptacle section, said further electrical contact engages said first beam, said first beam deflects toward and engages said second beam, whereupon said second beam is engageable with said overstress member projection, said overstress member being operative when said second beam presses thereon.

18. An electrical receptacle contact, comprising:

(a) a receptacle section for receiving a further electrical contact, said receptacle section comprises a wall section;

(b) said wall section comprises a layer of conductive material;

(c) said layer of material comprises first and second deflectable beams extending therefrom each comprising a respective free end, said first beam is adapted to engage said further electrical contact upon insertion thereof into said receptacle section, said second beam is arranged to be engaged by said first beam upon insertion of said further electrical contact, and said layer of material further comprises an overstress member comprising a free end;

(d) said second beam free end is disposed intermediate said first beam free end and said overstress member free end for engagement therewith; and (e) upon insertion of said further electrical contact into said receptacle section, said first beam deflects toward and engages said second beam, whereupon said second beam is engageable with said overstress member free end, said overstress member being operative when said second beam free end presses thereon.

19. An electrical receptacle contact, comprising;

(a) a receptacle section for receiving a further electrical contact, said receptacle section comprises a wall section;

(b) said wall section comprises first and second overlapping layers of conductive material, said overlapping layers thereby define a double thickness wall section;

(c) said first layer of material comprises two cantilever beams extending therefrom and each includes a free end for deflection upon insertion of said further electrical contact into said receptacle section, and an overstress member comprising an end which is engageable with said cantilever beams free end; and (d) during flexure of the cantilever beams, one of the cantilever beams engages the other of the cantilever beams and the other of the cantilever beams engages the overstress member to prevent overstress in both of the cantilever beams.

* * * * *